United States Patent [19]

Herbert et al.

[11] Patent Number: 4,942,353

[45] Date of Patent: Jul. 17, 1990

[54] HIGH FREQUENCY MATRIX TRANSFORMER POWER CONVERTER MODULE

[75] Inventors: Edward Herbert, Canton; John D. Repp, Barkhamsted; Stephen E. Cebry, Burlington, all of Conn.

[73] Assignee: FMTT, Inc., Canton, Conn.

[21] Appl. No.: 415,043

[22] Filed: Sep. 29, 1989

[51] Int. Cl.[5] ..... H01F 33/00

[52] U.S. Cl. ..... 323/361; 336/175; 336/212

[58] Field of Search ..... 307/83; 323/361; 336/175, 212

[56] References Cited

U.S. PATENT DOCUMENTS

| | | | |
|---|---|---|---|
| 2,600,057 | 6/1952 | Kerns | 336/175 |
| 2,667,542 | 1/1954 | Wright | 336/212 |
| 3,105,959 | 10/1963 | Klinkhamer | 365/225.5 |
| 3,110,888 | 11/1963 | Kluck | 365/225.5 |
| 3,323,091 | 5/1967 | Hibbits | 336/175 |
| 4,513,167 | 4/1985 | Brandstetter | 323/906 |
| 4,665,357 | 5/1987 | Herbert | 336/175 |
| 4,845,606 | 7/1989 | Herbert | 336/175 |

*Primary Examiner*—Peter S. Wong
*Assistant Examiner*—Jeffrey Sterrett
*Attorney, Agent, or Firm*—McCormick, Paulding & Huber

[57] ABSTRACT

A high frequency matrix transformer power converter module includes a dedicated, pre-wired secondary winding, inductor and filter capacitor wherein the electrical conductor forming the dedicated secondary winding is made from a flat ribbon material and passes through adjacent cores forming the interdependent magnetic elements of the matrix transformer such that helical portions of the conductor forming the winding are in complementary arrangement within the core structure and provide an opening through which a second electrical conductor forming a primary winding may be inserted after the module is constructed to obtain the desired transformation characteristics. A number of modules may be arranged side-by-side to provide a higher power output wherein the output voltage busses of the modules are connected together and wherein through holes of each module are in registry to permit wiring of an undedicated primary winding to obtain the desired power output.

12 Claims, 2 Drawing Sheets

HIGH FREQUENCY MATRIX TRANSFORMER POWER CONVERTER MODULE

BACKGROUND OF THE INVENTION

The present invention relates generally to power converter systems and deals more particularly with a matrix transformer power converter module having a dedicated, pre-wired secondary winding and provisions for post installation wiring of an undedicated primary winding.

The problems associated with the construction and operation of conventional high frequency power converters are well known. Conventional converters utilize bulky foil transformers and conductors, require complex and costly sheet metal fabrication for interconnections, exhibit Poor thermal conductivity and poor shock and vibration characteristics among others. In addition, the power output for a given design is generally fixed so that higher power output requirements necessitate new designs and larger, bulkier components. Accordingly, a user is restricted to the available power outputs produced by the commercially available units or must undertake a new design to accommodate the performance specifications of the specific application. Furthermore, all conventional power converters are pre-wired and any attempt to "customize" a given converter requires major modifications to the converter components.

The development of the matrix transformer as described in U.S. Pat. No. 4,665,357 issued May 12, 1987 to Herbert and assigned to the same assignee as the Present invention has solved a number of problems and drawbacks associated with conventional bulky transformers. For further details of the matrix transformer and its operation, reference may be made to the above-identified Patent and which disclosure is incorporated herein by reference.

The features and advantages of the matrix transformer are used in the present invention to provide a matrix transformer module having a dedicated, pre-wired secondary winding and provision for an undedicated primary winding to permit a user to employ one or more modules to achieve a desired power output by passing the electrical conductor of the primary winding through each of the modules after the construction, installation and mounting of the modules.

It is therefore the general aim of the present invention to provide a matrix transformer module for a high frequency power converter that generally overcomes the problems associated with known power converters.

It is a further aim of the present invention to provide a matrix transformer module that has a dedicated, pre-Wired secondary winding and provision to permit the post wiring of an undedicated Primary wiring through one or more modules to achieve a desired power output.

It is yet a further aim of the present invention to provide a dedicated winding made from an electrical conductor to have a shape and configuration which forms a passage through the magnetic core structure of the matrix transformer section of the module to permit post wiring installation of the primary winding.

SUMMARY OF THE INVENTION

In accordance with the present invention, a matrix transformer module for use in a high frequency power converter is presented. The module includes at least one interdependent magnetic element which defines a matrix transformer section and includes means in each of the interdependent magnetic elements defining at least one Winding that comprises an electrical conductor having first and second ends and where the winding passes at least once through each of the interdependent magnetic elements. The one winding is a dedicated, pre-Wired winding and for purposes of explanation is considered to be a secondary winding. The winding has a shape and configuration which defines a passage for receiving a second electrical conductor which forms a second winding, considered for explanatory purposes to be the primary winding.

The module may further include an inductor having one terminal coupled to the secondary winding and its other terminal connected to a first output terminal of the module which defines a first voltage distribution bus whereby the inductor is in series between the secondary winding and the first output terminal. The module further includes a second voltage distribution bus which is physically and electrically separated and insulated from the first voltage distribution bus whereby a voltage potential is developed between the busses when the electrical conductor carrying an excitation signal is present to form the primary winding and to induce a voltage in the secondary winding. The module may further include a capacitor in close proximity to the inductor and is coupled between the first and second voltage distribution busses to form an output voltage filter.

In a further aspect of the invention, a power semiconductor rectifier circuit may be mounted in close proximity to the secondary winding to rectify the output voltage potential developed between the voltage distribution busses.

The matrix transformer section includes a dedicated winding which may be made from a flat ribbon sheet metal material which is U-shaped and has legs extending through the magnetic cores comprising the interdependent magnetic element wherein the legs include an elongated helical portion having a shape and size conforming to the inner periphery of the magnetic core such that the secondary winding comprises two such U-shaped members in a complementary arrangement to define a passageway through the core and winding to allow an electrical conductor to be post installation wired as a primary winding in accordance with the number of modules used and in accordance with the number of primary turns that are required for the given power application.

BRIEF DESCRIPTION OF THE DRAWINGS

Other features and advantages of the Present invention will become readily apparent from the following written description and figures wherein.

DETAIL DESCRIPTION OF THE PREFERRED EMBODIMENTS

Figure 1:
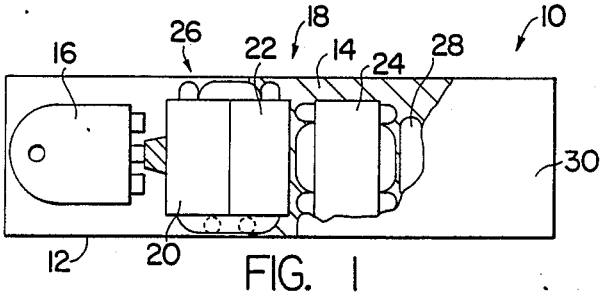
FIG. 1 is a schematic top plan view of the high frequency matrix transformer power converter module of the present invention illustrating the placement of the major components comprising the converter module.

Turning now to the drawings and considering the invention in further detail, FIG. 1 illustrates a typical component placement wherein the module, generally designated 10 is carried on a thermally conductive base plate 12 and includes a voltage distribution bus 14 in the form of a sheet metal conductive materials such as copper. The bus 14 has an elongated rectangular shape conforming to the basic module package configuration. In FIG. 1, the bus 14 is illustrated connected to a power semiconductor rectifying device 16 which may be mounted and heat sinked in a manner well known in the art. A matrix transformer section generally designated 18 includes a number of magnetic core structures 20, 22 and an inductor 24. The cores 20, 22 include a secondary winding, illustrated as a push-pull winding 26, prewired as a dedicated secondary winding and which is physically arranged as described below to permit the passage of an electrical conductor which serves as an undedicated primary winding for the module. The module 10 further includes a filter capacitor 28 connected between the inductor 24 and the voltage bus 14 and which capacitor serves to filter the DC output voltage when the module is interwired with a primary winding to excite the transformer. A second voltage distribution bus 30 (shown partially cut away to reveal the inductor 24 and capacitor 28) is connected to one terminal of the inductor 24 and to one terminal of the capacitor 28. In operation, the matrix transformer power converter module develops a voltage potential between the two voltage distribution busses 14 and 30.

Figure 2:
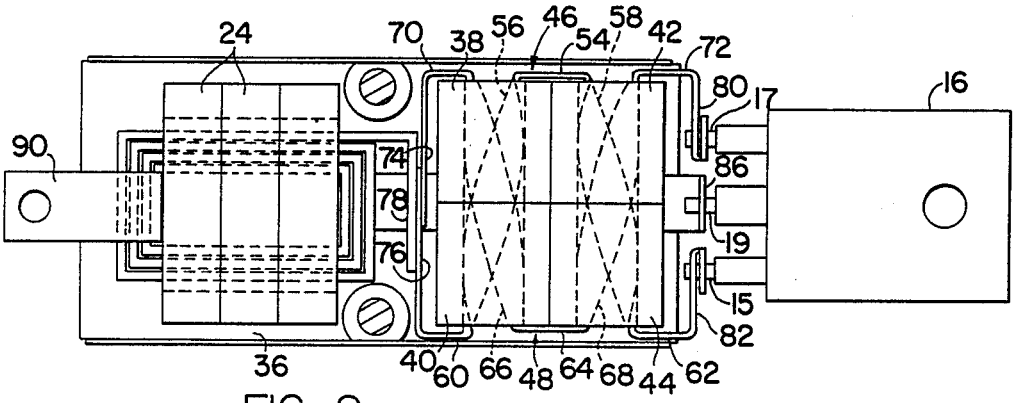
FIG. 2 is a schematic top plan view of the high frequency matrix transformer power converter module illustrating the inductor connected to one end of the dedicated, pre-wired winding of the matrix transformer section wherein the opposite ends of the winding are coupled to a power semiconductor rectifying device.
Figure 3:
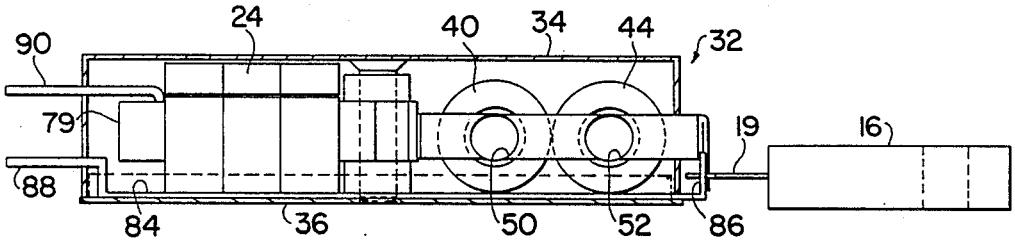
FIG. 3 is a schematic, side elevation view of the high frequency matrix transformer power converter module of FIG. 2.

Turning now to FIGS. 2 and 3, a matrix transformer section is illustrated coupled to a power semiconductor rectifying device. The module is shown as being contained within an enclosure 32 having a cover 34 and a base 36. The primary winding is unconstrained and may be a push-pull winding, symmetrical push-pull winding, a bridge winding or a half bridge winding and it can be used in any circuit topology that uses transformer. In the illustrated embodiment, the interdependent magnetic element comprises four magnetic cores 38, 40, 42, 44. The magnetic cores are cylindrically shaped and cores 3B and 4B are placed end-to-end and are immediately adjacent to two cores 42, 44 which are also placed end-to-end. The dedicated secondary winding is illustrated as a push-pull winding wherein the winding is made up of two U-shaped electrical conductors 46, 48 which form the secondary winding and also serve to define the elongated axial openings 50, 52 through the respective core pairs. Although individual cores are illustrated, a singled, solid body core having passages extending through the body can be used. The shape of the body and the passages are not critical provided normal magnetic criteria are met. The specific shape and configuration of the U-shaped members is described in further detail below.

As illustrated in FIGS. 2 and 3, the U-shaped member 46 has a bridging member 54 which is continuous with and integral to the axially elongated helical portions 56, 58 of each respective leg of the U-shaped member. In addition, each respective leg includes an elongated portion 60, 62 integral and continuous with a respective helical portion 56, 58. The U-shaped member 48 is similarly constructed and includes a bridging member 64 integral and continuous with two helical portions 66, 68 of each respective leg of the U-shaped member. Each leg further has an elongated portion 70, 72 integral to and continuous with each respective helical portion 66, 68 of the legs of the U-shaped member 48. One end 74 of the U-shaped member 46 is connected to one end 76 of the U-shaped member 48 and to one end 78 of the conductor 24. The opposite end 80 of the U-shaped member 48 is connected to one terminal 17 of the power semiconductor device 16. The other end 82 of the U-shaped member 46 is connected to another terminal 15 of the power semiconductor device !6 as illustrated. As can be seen, the U-shaped members 46 and 48 defining the dedicated secondary winding is fabricated and configured such that the conductor 24 and the power semiconductor device 16 maybe located in close proximity to the cores and windings forming the matrix transformer sections.

The module of FIGS. 2 and 3 show a secondary winding made from a pair of helical U-shaped formed conductors which provide a substantial conductor and a large, round through hole. However, the winding can be made of any material customarily used to make windings, in any configuration and with any number of turns, provided only that there are sufficient window area remaining to provide a through hole.

Also, the module is illustrated in a configuration suitable for a secondary of a matrix transformer. In any transformer, "primary" and "secondary"are arbitrary designations and can be interchanged for different applications. A matrix transformer can have a plurality of primaries, interwired in parallel, with a series secondary. For such a transformer, the modules would use or connect to primary switching means. A number of modules can be placed side-by-side with their through holes aligned and a secondary winding can then be wound through the aligned through holes as required for the application.

Although cylindrical shaped magnetic cores are illustrated, it will be recognized that other shapes may be used and that the U-shaped members will have legs conforming to the inner peripheral shape of the cores. For instance, with square or rectangular through holes, a folded sheet metal U-shaped conductor member can be used. Obviously the several cores could be replaced with one solid core having two through holes.

As can be seen in FIG. 3, one voltage distribution bus 84 one end 86 connected to a terminal 19 of the power semiconductor device 16 and its opposite end 88 serves as one output terminal of the power converter module. A second output terminal 90 from the Power converter module is connected to one terminal 79 of the inductor 24 and across which terminals 88 and 90 is developed the desired rectified DC voltage potential having the desired power rating.

Figure 4:
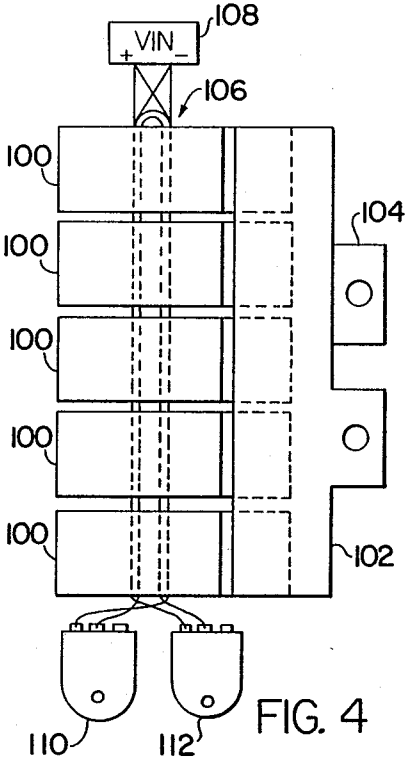
FIG. 4 is a schematic top plan view of a number of power converter modules having their respective outputs connected in parallel to produce a higher power output wherein the modules are shown with a primary winding passing through each of the adjacent modules.

FIG. 4 illustrates schematically five matrix transformer power converter modules 100, 100 arranged with their respective like voltage output terminals connected to one bus bar !02 and their other respective like voltages output terminals connected to another bus bar 104. A primary winding 106 is shown representatively as a symmetrical push-pull winding connected to a DC voltage input represented by function block 108. The electrical conductors forming the primary winding are inserted through the passages (shown as openings 50, 52 in FIG. 3) and connect to switching semiconductor devices 110, 112 which are alternately energized between a conductive and nonconductive state to produce the excitation voltage in the primary winding which induces a voltage in the dedicated, pre-wired secondary winding of each module to produce the desired voltage output potential across the bus bars 102 and 104. The present invention provides flexibility to a user since the number of turns of the primary winding 106 may be increased or decreased after the converter modules are constructed and arranged as shown since the primary winding is undedicated and wired separately from the dedicated, pre-wired secondary winding. The primary winding is unconstrained and may be a push-pull winding, symmetrical push-pull winding, a bridge winding or a half bridge winding and it can be used in any circuit topology that uses transformers. The converter may operate at different DC voltage inputs for a desired DC voltage and current output by changing the number of turns of the Primary winding and the driver semiconductors 110 and 112.

Figure 5:
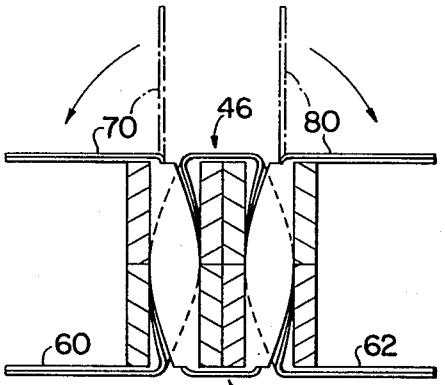
FIG. 5 is a schematic top plan view of a matrix transformer section made up of a number of magnetic cores interwired with a dedicated winding formed from complementary U-shaped electrical conductors having a semihelical portions which define a coaxial opening through the cores and through which an electrical conductor of undedicated winding is passed.
Figure 7:
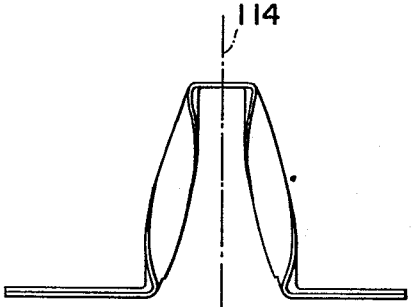
FIG. 7 illustrates in greater detail the U-shaped electrical conductor of the dedicated winding.

Turning to FIG. 5, the U-shaped members 46 and 48 described above and in connection with FIG. 2 are illustrated schematically inserted in the magnetic cores of a matrix transformer. The surface area within the core conforms to the inner circumferential peripheral shape of the core and is axially elongated and symmetrical about a longitudinal axis 114 as illustrated in FIG. 7. The two U-shaped members 46 and 48 are inserted from opposite directions through the magnetic cores with the respective elongated sections 70 and 80 of each leg of the U-shaped member 48 extended in the longitudinal direction as illustrated by the phantom representation. Likewise, the elongated portions 60, 62 of each respective leg of the U-shaped member 46 also are in the axially elongated orientation when inserted into the cores. As can be seen, the U-shaped members provide a method of forming a dedicated, pre-wired winding in the core structure that provides a large surface area to carry large currents while providing for a coaxial opening through the core and through which opening an electrical conductor serving as a second winding may be inserted after the module is constructed. It can be seen from FIG. 5 that a matrix transformer module having a core, and a dedicated winding with through holes can be made wherein the module may be used in various configuration of a matrix transformer allowing an undedicated winding or windings to be added as design requirements dictate.

Since the legs of the U-shaped members may be bent at right angles and are made of sheet material, the matrix transformer structure is dimensionally smaller and less bulky than a conventional transformer. The relative compactness of the matrix transformer section construction permits components to be mounted in close proximity to matrix transformer to minimize connection distances which improves high frequency operation. The axially elongated portions of the legs of the U-shaped members may be fabricated and folded in different orientations to permit mounting in a printed circuit board, surface mounting and other mounting configurations as is known in the art. Also, the ends of the legs may be configures as pins, tabs and the like.

Figure 6:
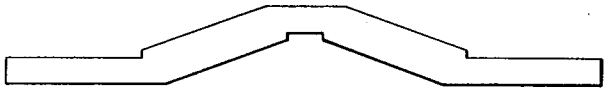
FIG. 6 illustrates the shape of the flat ribbon sheet material from which the U-shaped conductor comprising the dedicated windings is formed.

FIG. 6 is a plan view of the U-shaped member as cut or stamped from sheet material prior to bending into its U-shaped and the formation of the semi-helical sections.

The design of the semi-helical Portions of the U-shaped conductor allows at least four magnetic cores to be used in the matrix transformer section and eliminates the need for external crossovers that are present when conventional wire conductors are used for the windings. In addition, since the dedicated secondary winding provides a substantial reduction in the space normally required with conventional transformers, it is relatively easy to provide additional insulation between the secondary winding and the core while still providing sufficient space for the electrical conductor of the primary winding and also for additional insulation between the electrical conductor of the primary winding and the secondary winding.

Figure 8:
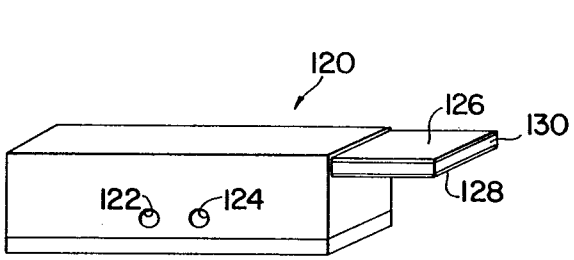
FIG. 8 is a pictorial representation of a potted power converter module wherein the through holes for receiving the electrical conductor of the undedicated winding are illustrated.

Turning now to FIG. 8, a pictorial representation of a potted power converter module embodying the present invention is illustrated therein and generally designated 120. The matrix transformer power converter module is constructed in the normal manner and then encapsulated leaving axial through holes 122 and 124 extending transverse by through the module to permit wiring of the undedicating primary winding. The potted module 120 also includes voltage distribution busses 126 and 128 which may be connected to an external bus bar in a similar manner as illustrated in FIG. 4. As shown in FIG. 8, the voltage distribution busses 126 and 128 sandwich an insulating circuit card 130. As in the multiple module converter illustrated in FIG. 4, the primary winding and the number of modules used of the potted module 120 of FIG. 8 may be changed to accommodate various magnitude DC input voltages to provide a desired output voltage and current. In general, the greater number of modules used produce a higher output current and accordingly an increase in power. For a give output voltage, adding turns to the windings or adding modules or both allows an increased input voltage to be used.

Figure 9:
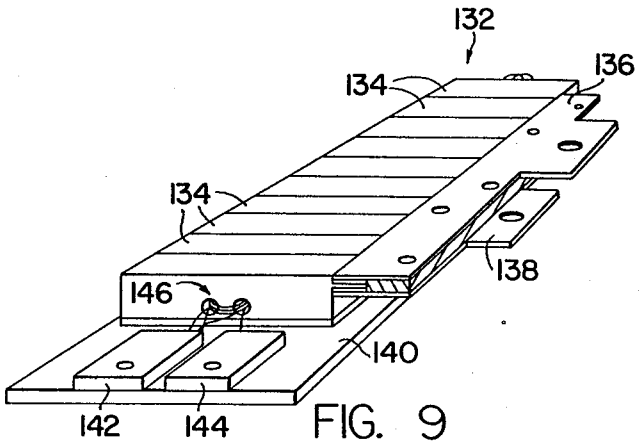
FIG. 9 is a pictorial representation of a number of potted power converter modules arranged side-by-side on an insulated circuit card wherein the output terminals within the modules are connected to power busses.

FIG. 9 is a pictoral representation of a number of potted matrix transformer power converter modules arranged side-by-side on an insulated circuit card and illustrates an arrangement of ten modules to form a power converter generally designated 132. Each of the modules 134, 134 have their respective like voltage output terminals connected to a respective voltage distribution bus !36 and !38. The modules are mounted on a circuit card 140 which may also function as a heat sink for the converter modules. The modules may further be mechanically attached to the board 140 to provide better thermal conductivity. Also shown mounted on the board 140 are semiconductor Power switching devices 142, 144 connected to a primary winding generally designated 146 and which electrical conductor forming the primary winding 146 interwires the modules 134, 134 after they have been installed and in accordance with the DC voltage input and output voltage and current requirements. Again it can be seen that the matrix transformer power converter module embodying the present invention permits the construction of a high frequency, high power convertor that operates efficiently and effectively at high frequency while retaining a low profile and a compact package configuration.

A high frequency matrix transformer power converter module has been described above in several preferred embodiments. It will be understood that numerous changes and modifications may be made without departing from the spirit of the invention and therefore the invention has been presented by way of illustration rather than limitation.

We claim

1. Matrix transformer converter module for use in a high frequency power converter, said module comprising, at least one interdependent magnetic element defining a matrix transformer section;

means in each of said at least one interdependent magnetic elements defining at least one winding comprising an electrical conductor and having first and second ends, said at least one winding passing at least once through each of said at least one interdependent magnetic elements defining said matrix transformer section:

said means defining said at least one winding further means defining a passage for receiving a second electrical conductor having first and second ends to form at least one second winding:

inductor circuit means having two terminals, one of which terminals is coupled to said at least one winding and the other of which terminal is coupled to a output terminal defining a first voltage distribution bus whereby said inductor circuit means is in series between said at least one winding and said output terminal, and a second voltage distribution bus, said first and second distribution busses being physically and electrically separated from one another whereby a voltage potential is developed between said busses when an electrical conductor carrying an excitation signal is present to form said second winding.

2. Matrix transformer converter module as defined in claim 1 further comprising capacitor circuit means in close proximity to said inductor circuit means and coupled between said first and second voltage distribution busses to form an output voltage filter.

3. Matrix transformer converter module as defined in claim 2 further comprising semiconductor power rectifier circuit means in close proximity to said matrix transformer section and coupled to said first and second ends of said electrical conductor comprising said at least one winding for rectifying said voltage potential developed between said busses.

4. Matrix transformer converter module as defined in claim 3 wherein said power semiconductor rectifier circuit means said is carried on and supported by a thermally conductive base plate having two planar surfaces disposed opposite one another.

5. Matrix transformer converter module as defined in claim 2 further comprising said first and second voltage distribution busses being carried and supported by an insulated circuit card having two planar surfaces disposed opposite one another.

6. Matrix transformer converter module as defined in claim 5 wherein said first and second voltage distribution busses are disposed opposite one another on said opposite surfaces of said insulated circuit card, said busses having a generally rectangular shape with two longitudinal sides and two transverse sides generally smaller in dimension than the sides to form a generally rectangular longitudinally elongated package.

7. Matrix transformer converter module as defined in claim 6 wherein said matrix transformer section comprises means defining at least one magnetic core.

8. Matrix transformer converter module as defined in claim 7 further comprising said at least magnetic core being a solid body having first and second passages extending therethrough each having an inner circumferential surface and a first and second end portion;

said at least one winding further comprising a U-shaped electrical conductor substantially symmetrical about a longitudinal axis and defining two legs which are substantially parallel to one another and in a spaced apart relationship, said legs having a bridging portion formed from the electrical conductor and extending transversely between said legs at the U-end of said electrical conductor, one leg of said U-shaped conductor being associated with and passing through said first passage and the other leg of said U-shaped conductor being associated with and passing through said second passage, and said legs of said U-shaped conductor further comprise an axially elongated portion and a continuous, axially elongated semi-helical portion terminating at and in said bridging portion, said axially elongated semi-helical portion having a surface contour substantially conforming to the inner peripheral surface of said first and second passage said semi-helical section having an axial length dimension substantially equal to the longitudinal dimension of said first and second passages in said core body through which said leg passes, said semi-helical sections being arranged for complementary placement with a semi-helical section of a second U-shaped conductor within the inner peripheral surface, said second U-shaped conductor entering said core body through the opposite end portion of said core body from which said first U-shaped conductor enters whereby said conductors form a dedicated and pre-wired winding defining a coaxial opening through said first and second passages.

9. Matrix transformer converter module as defined in claim 7 further comprising said at least magnetic core having a number of cylindrically shaped cores each having an inner circumferential surface and a first and second end portion;

said at least one winding further comprising a U-shaped electrical conductor substantially symmetrical about a longitudinal axis and defining two legs which are substantially parallel to one another and in a spaced apart relationship, said legs having a bridging portion formed from the electrical conductor and extending transversely between said legs at the U-end of said electrical conductor, one leg of said U-shaped conductor being associated with and passing through a first number of cores and the other leg of said U-shaped conductor being associated with and passing through a second number of cores, and said electrical conductor further comprising a flat ribbon sheet metal material and wherein each of said legs of said U-shaped conductor further comprise an axially elongated portion and a continuous, axially elongated semihelical portion terminating at and in said bridging portion, said axially elongated portion of said leg having a surface curvature substantially conforming to the inner circumferential peripheral surface of said core, said axially elongated semi-helica) portion having a surface curvature substantially conforming to the inner circumferential peripheral surface of said core, said semi-helical section having an axial length dimension substantially equal to the lonqitudinal dimension of said number of cores through which said leg passes, said semi-helical sections being arranged for complementary placement with a semi-helical section of a second U-shaped conductor within the inner circumferential peripheral surface, said second U-shaped conductor entering said core through the opposite end portion of said core from which said first U-shaped conductor enters whereby said conductors form a dedicated and pre-wired winding defining a coaxial opening through said cores.

10. Matrix transformer converter module as defined in claim 9 further comprising an insulating sleeve coaxial with said opening formed by said helical portions of said electrical conductors.

11. Matrix transformer converter module as defined in claim 9 further comprising said matrix transformer sections being arranged on said module so that said openings in cores in another converter module located immediately adjacent to said first module are in registry with one another.

12. Matrix transformer converter module as defined in claim 9 further comprising said module being potted.

* * * * *